United States Patent [19]

Donahue

[11] 4,222,319

[45] Sep. 16, 1980

[54] PAINT SPRAY BOOTH WITH FLOODED FLOOR

[75] Inventor: Joseph D. Donahue, Warren, Mich.

[73] Assignee: Schweitzer Industrial Corporation, Madison Heights, Mich.

[21] Appl. No.: 851,253

[22] Filed: Nov. 14, 1977

[51] Int. Cl.[2] ..... F23J 11/00

[52] U.S. Cl. ..... 98/115 SB; 55/227

[58] Field of Search ..... 98/115 SB; 118/326, 118/634, DIG. 7; 55/227

[56] References Cited

U.S. PATENT DOCUMENTS

| | | | |
|---|---|---|---|
| 2,086,514 | 7/1937 | Saunders et al. | 118/DIG. 7 |
| 3,321,191 | 5/1967 | Najarian | 55/227 X |
| 3,421,293 | 1/1969 | Halls | 98/115 SB X |
| 3,561,135 | 2/1971 | Fulford | 118/326 X |

FOREIGN PATENT DOCUMENTS

| | | | |
|---|---|---|---|
| 1518013 | 2/1968 | France | 118/326 |
| 2310161 | 12/1976 | France | 118/326 |

*Primary Examiner*—Wm. Carter Reynolds
*Attorney, Agent, or Firm*—Krass & Young

[57] ABSTRACT

A paint spray booth of the type having a forced air/water exchange for trapping paint overspray. A sub-floor beneath the working area comprises a flat pan which is deeply flooded with water and plural central discharge tubes, the sides of which are raised above the sub-floor to create a weir effect.

7 Claims, 2 Drawing Figures

PAINT SPRAY BOOTH WITH FLOODED FLOOR

INTRODUCTION

This invention relates to paint spray booths and more particularly to a paint spray booth incorporating a flooded sub-floor for the extraction of paint overspray.

BACKGROUND OF THE INVENTION

It is customary to spraypaint automobiles and other mass-produced articles in a spray booth having the physical characteristics of an elongated corridor or chamber through which the automobiles are longitudinally conveyed and within which a human operator or mechanical robot or a combination of same actuate paint spraying equipment. It is essential in the operation of a paint spray booth to maintain a proper supply of fresh air and to remove paint overspray by means of an air exhaust system.

Paint overspray is conventionally removed from the air by drawing the air through water flooded cylinders which are disposed along the center line of a sub-floor within the booth at longitudinally spaced intervals. The sub-floor is made up of two longitudinally continuous planes which slope toward the center line and which are flooded with a thin sheet of water which catches some of the paint overspray. A mixing action between air and water takes place within the spaced cylinders to catch the remaining paint overspray. Water flowing down through the cylinders drops into a relatively static pond which flows outwardly into a disposal sluice which runs from the paint spray booth to a treatment center. Such a paint spray booth is disclosed in the U.S. patent to Halls U.S. Pat. No. 3,421,293.

BRIEF SUMMARY OF THE INVENTION

The principal objective of the present invention is to improve upon the prior art paint spray booth which exhibits the sloping sub-floor system above described. More particularly, an objective of the invention is to provide a paint spray booth having a relatively flat flooded sub-floor which is more effective in handling both paint overspray and heavy chunks of accumulated paint from the perforated work floor, which simplifies the periodic sludge removal process, which reduces the amount of water required per lineal foot of paint spray booth, which reduces noise within the paint spray booth, which eliminates the possibility of dry spots and non-uniform water flow and which otherwise simplifies the water distribution function.

In general, the objectives set forth above are accomplished by providing a paint spray booth having a perforated working floor and a flat sub-floor which is relatively deeply flooded with water and which includes a plurality of longitudinally spaced cylindrical or tubular outlet structures, preferably spaced along the center line thereof, with the walls of said cylindrical structures being spaced above the sub-floor level quite substantially, i.e., on the order of three inches, so as to create the substantial depth of sub-floor flooding and to produce a weir effect.

Other features of the invention include a simplified water delivery system comprising inlet conduits which extend upwardly through the sub-floor from a supply conduit. Other features and advantages of the invention will be more fully set forth hereinafter.

DETAILED DESCRIPTION OF THE SPECIFIC EMBODIMENT

Figure 1:
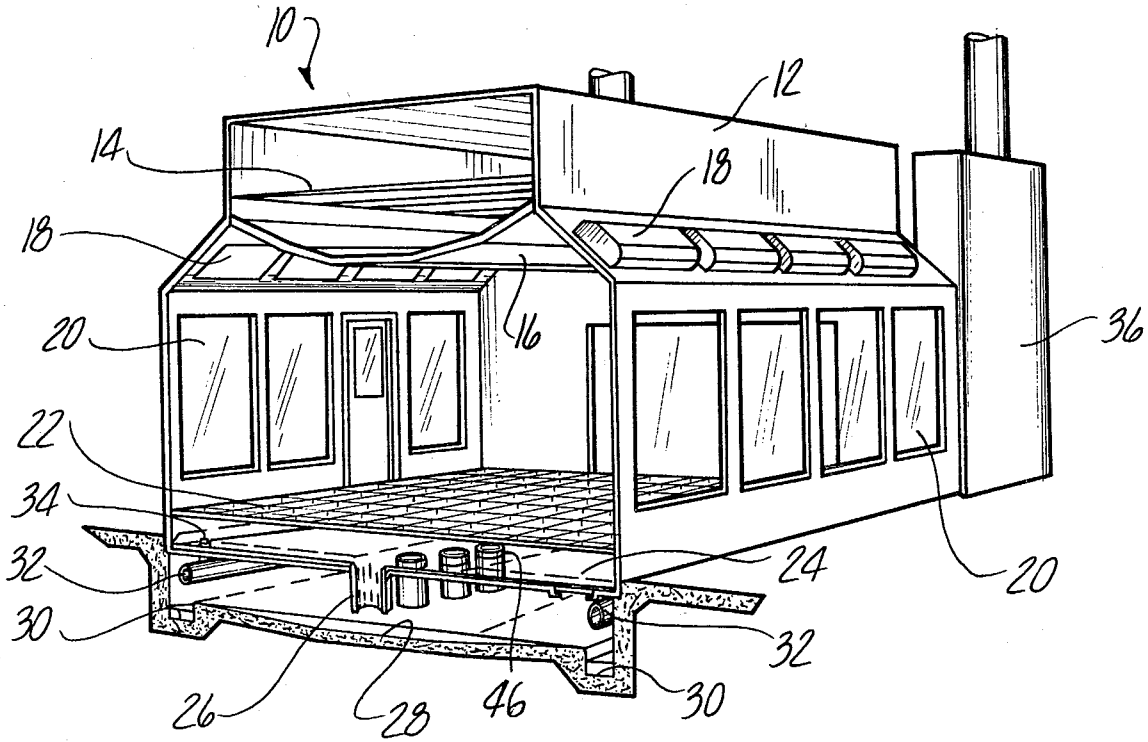
FIG. 1 is a simplified perspective drawing of a section of a paint spray booth incorporating the features of the present invention.

Referring to FIG. 1, there is shown a paint spray booth for automobiles or other mass-produced articles and comprising an elongate housing structure 10 defining a large open interior area through which automobiles are towed by means of a conveyor and around which a human operator may move to spray paint on the automobile bodies as they pass longitudinally through the structure 10. Above the main working area is an air supply plenum 12 having adjustable baffles 14 and a diffusion ceiling 16 made of porous urethane foam. Lights 18 are disposed continuously along the spray booth structure 10 to illuminate the working area. Windows 20 may be disposed in the sidewalls of the structure 10 to permit the interior operations to be viewed and to create an open airy atmosphere within the spray booth.

Figure 2:
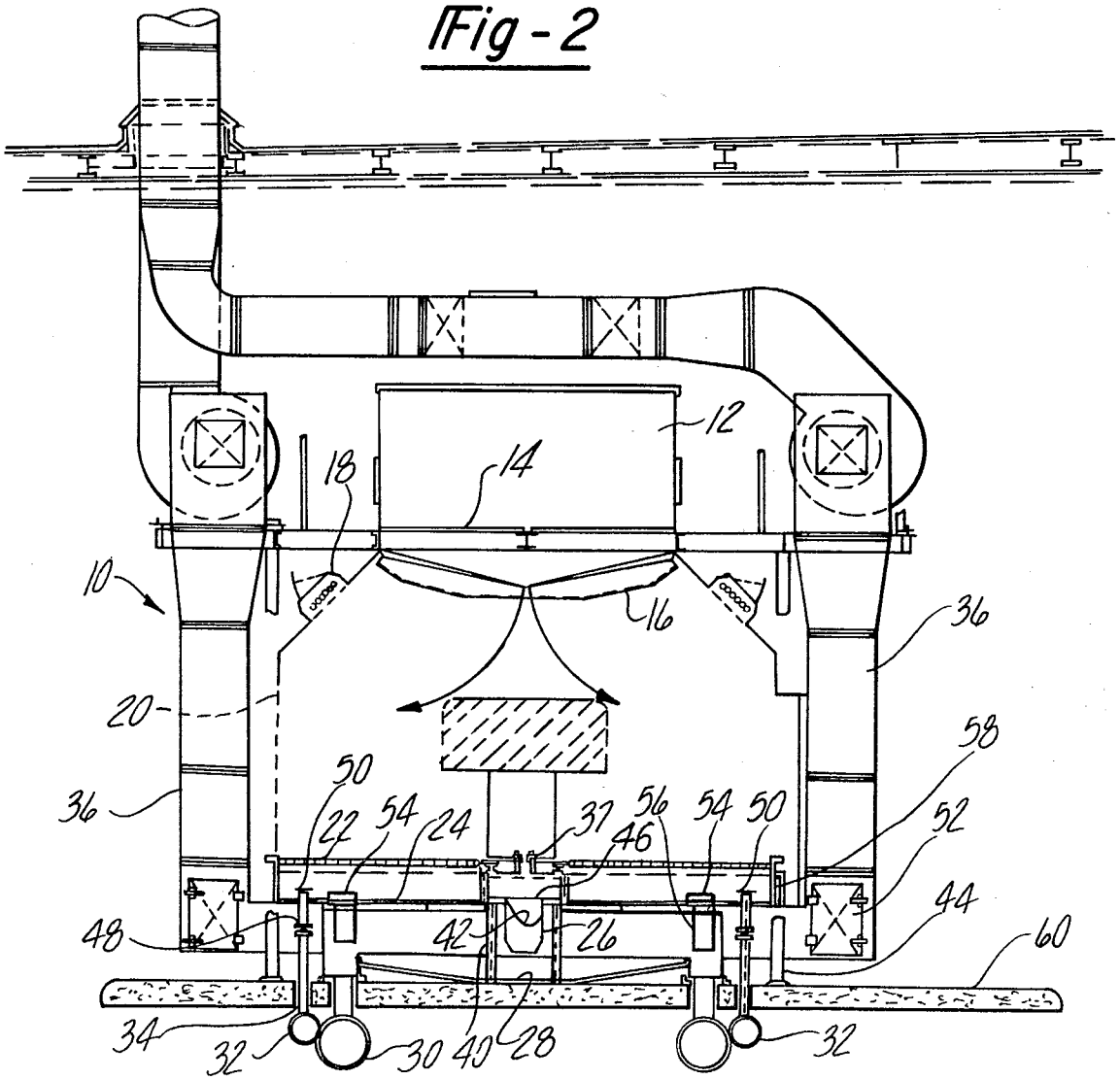
FIG. 2 is a detailed cross-sectional drawing through a paint spray booth incorporating the features of the invention.

The working floor is defined by a full width grating 22 which, as shown in FIG. 2, typically includes a conveyor structure 37 for towing automobiles or other articles longitudinally through the booth. Disposed approximately 18 inches beneath the grating 22 is a sub-floor 24 in the form of a deep pan which is substantially flat, i.e., does not slope from the outside edges toward the center as is common to the prior art. Centrally of the sub-floor pan 24 are a plurality of longitudinally spaced cylinders 26. The cylinders are preferably fabricated from thin gage metal, galvanized or plated for corrosion resistance, and welded or otherwise secured in place within the sub-floor 24. Although dimensions are given by way of example rather than by way of limitation, a preferred arrangement includes cylinders 26 of approximately 18-inch diameters spaced longitudinally along the sub-floor at a spacing of 30 inches between centers.

As noted in FIG. 1 the cylinder sidewalls extend above the floor 24 by approximately three inches thereby creating a pool of approximately three inches in depth when the sub-floor is supplied with water as hereinafter described. In addition, the three-inch rise above the sub-floor 24 creates a weir effect which increases the speed of flow in the immediate vicinity of the cylinders 26, also as hereinafter defined. Cylinders 26 extend approximately two feet below the sub-floor 24 and preferably contain baffles, helical vanes, watersprays, or such other mechanisms as will create a mixing action of air and water within the cylinders for the effective removal of fine paint overspray as hereinafter described.

Cylinders 24 are spaced above a trough-shaped flooded base floor 28 which slopes laterally upwardly to both sides toward drain sluices 30. The sluices 30 on opposite sides of the base floor 28 convey paint laden water to a treatment plant not shown.

Water is supplied to the sub-floor 24 by means of longitudinally extending conduit 32 having spaced vertically extending distributor legs 34 which extend upwardly through the sub-floor as best shown in the left side of FIG. 1 and again in FIG. 2. A large volume of water may be supplied to the sub-floor 24 by means of the distributor pipes 34 on a substantially continuous basis. Air which is pulled down through the cylinders 26 in the sub-floor 24 is exhausted from the spacing between the sub-floor 24 and the base floor 28 by means of longitudinally spaced exhaust plenum 36. Because of the extremely effective paint removal action of the subject booth, the air emitted from the exhaust plenum 36 tends to be very clean and bearing a minimum paint overspray.

In operation, air is forced by turbines or other suitable means to flow into the supply plenum 12 downwardly through the diffusion ceiling 16, around the automobile or other object being spraypainted in the working area, through the grating 22, thence downwardly through the cylinders 26 in the sub-floor 24 and thence back to the atmosphere through exhaust plenum 36. Paint overspray which is picked up in the working area tends to be exchanged into the water system by direct contact with the three-inch deep quantity of water on the sub-floor 24, and again at the mixing sites provided by the cylinders 26. The paint-laden water flowing downwardly through the cylinders 26 impacts the surface of the pond on the sub-floor 28 and flows outwardly to the sluices 30 where it flows toward the treatment center. Treated water may be recirculated into the supply conduit 32 where it is again used to maintain the flooding action of the flat sub-floor 24. Paint overspray which adheres to and accumulates on the grating 22 may eventually form relatively large deposits. After a time these deposits fall through the grating 22 into the three-inch deep pond of water on the sub-floor 24. Because of the depth of the water pond on the sub-floor 24 such paint deposits tend to be completely submerged and lay on the bottom of the sub-floor where they are kept wet, thus facilitating later removal by manual scraping and/or high-pressure water guns at the cleaning interval. Moreover, the substantial depth of the water pond on the sub-floor 24 tends to permit surface water to flow easily over and around the large paint deposits which fall from the grating 22, thereby maintaining the effectiveness of the water surface to catching and removing the fine paint overspray which is carried down into the sub-floor area by the forced air flow.

Referring now to FIG. 2, the details of an actual paint spray booth structure will be disclosed in such full and complete detail as to permit persons skilled in the art to actually fabricate a spray booth therefrom. As stated above, the drawing of FIG. 2 is a full section through an actual spray booth at a location which reveals all of the essential details of both the air and water systems.

In FIG. 2 structure corresponding to that shown in FIG. 1 has been identified with like reference characters. Accordingly, the main spray booth structure 10 is again shown to define the overhead air supply plenum 12, the adjustable perforated baffles 14 and the diffusion ceiling 16 for supplying air uniformly to the interior working space of the paint spray booth. The bar grating 22 is interrupted at the center by a conventional conveyor unit 37 for towing automobiles through the paint spray area. As shown in the drawing, the interior dimension of the booth is approximately 20 feet, thus permitting substantial working room for a human operator to move around an automotive vehicle.

Sub-floor 24 is formed beneath the grating 22 and spaced therefrom by means of tubular supports 40 to define a spacing of approximately 18 inches. The cylindrical tubes or cylinders 26 rise above the sub-floor 24 by approximately three inches. Each cylinder 26 is fitted with a set of interior vanes 42 of the type disclosed in the Halls patent so as to create a flushing or mixing action of air and water for the effective removal of paint overspray. Alternatives exist; for example, the mixing structure of U.S. Pat. No. 3,934,495 may be used, the objective being to create an effective transfer of paint overspray from air to water in the vicinity of the tubes 26. The sub-floor 24 is supported relative to the base floor 28 by means of tubular supports 44 so as to create a spacing of just over three feet. Sub-floor 28 is defined by a large metal plate which slopes upwardly toward the right and left lateral extremes as shown in FIG. 2. At the left and right extremes, the sub-floor abuts the sidewall 46 of a longitudinally extending water disposal sluice 30, the main tube of which extends to the treatment center as previously described.

The water for the flooded floor is provided by means of supply conduit 32 having spaced upstanding feeder pipes 34. Balancing valves 48 are disposed within the feeder pipes 34. The feeder pipes extend through the sub-floor and to a point approximately four inches above the sub-floor. A deflection plate 50 is disposed above and spaced from the outlet end of each feeder pipe 34 so as to prevent water from spraying up through the grating 22.

The air exhaust plenum 36 is connected by suitable ducting to the laterally opposite sides of the spaced between the sub-floor 24 and the base floor 28 as shown. Access doors 52 may be provided for periodic clean-out.

Sludge removal from the sub-floor 24 may be facilitated by longitudinally spaced covers 54 in the sub-floor connecting with cylindrical pipes 56 spaced immediately over the water sluice 30. Clean-out may thus be achieved by shutting off the flooded floor water supply, opening the cover 54 in the floor hatch and discharging accumulated paint deposits through the pipes 56 directly into the sluice 30. Additionally or alternately, a door 58 may be placed in the lateral end wall of the booth structure such that a disposal box might be placed beneath the door on the concrete floor 60, the door opened and semi-dry accumulated sludge simply scraped or pushed out through the door and into the trash container. As mentioned above, the fact that the accumulated heavy paint deposits are kept under water until removed tends to substantially facilitate the removal operation as well as to promote the effective removal of paint overspray by contact with the flooded floor surface as previously described.

Although not intended by way of limitation, it has been found that the sidewall 46 of the sluice structure should extend approximately $1\frac{1}{2}$ inches above the inner section with the sub-floor 28 so as to provide an adequate depth water pond over and along the base floor 28; the water supply or feeder pipes 34 as well as the discharge sluice structures may be spaced approximately ten feet apart, the depth of the pond immediately beneath the discharge end of the tubes 26 should be approximately ten inches (this depth will be depressed somewhat in the center due to the force of the airflow). The disposal caps 54 may be placed approximately every 40 feet. Various other dimensional relationships will be apparent from the drawing of FIG. 2 which is substantially to scale.

The embodiment of the invention in which an exclusive property or privilege is claimed is defined as follows:

1. In a paint spray booth of the type comprising an elongate housing defining a working area, a perforate working floor, and means for supplying air to the working area from overhead and for causing a flow of said air downwardly through the working floor:

the improvement comprising a flat sub-floor spaced from and beneath the working floor, means for flooding said flat floor with water to a substantial depth so as to receive and submerge paint deposits from said working floor as well as to receive on the surface of water thereon fine paint overspray from the air, a plurality of longitudinally spaced discrete outlet structures in said sub-floor, said outlet structures having upstanding sidewalls which extend above the surface of said sub-floor to the extent of said substantial depth, and means beneath said sub-floor for receiving and discharging paint-laden water from said outlet structures, said means for receiving comprising a base floor extending longitudinally beneath and laterally of said outlet structures, and disposal sluices at the opposite lateral extremes of said base floor, the combination further comprising hatch means in said sub-floor over said disposal sluices for draining and cleaning said sub-floor.

2. Apparatus as defined in claim 1 wherein said means for flooding comprises a water supply conduit extending longitudinally along and beneath said sub-floor and a plurality of spaced feeder pipes extending upwardly through said sub-floor to supply water thereto.

3. Apparatus as defined in claim 2 further including balancing valves in said feeder pipes.

4. Apparatus as defined in claim 1, wherein said base floor slopes laterally upwardly and laterally outwardly from the center thereof.

5. Apparatus as defined in claim 1 further including means in said outlet structures for producing a mixing of air and water flowing therethrough.

6. Apparatus as defined in claim 1 including means for conveying articles longitudinally through the booth.

7. A paint spray booth comprising an elongate housing defining a working area, a perforate working floor extending substantially the full width of said working area, forced air supply and exhaust means for causing a flow of air through said elongate housing substantially from top to bottom, a flat sub-floor disposed beneath and spaced from said perforate working floor and extending substantially the full width of said working area, water supply means disposed at laterally opposite extremities of said sub-floor for flooding said sub-floor with water to a substantial depth so as to receive and submerge paint deposits from the working floor and to create a relatively calm pond of water on said sub-floor, a plurality of discrete hollow tubular outlet structures disposed in and longitudinally spaced along said sub-floor, sidewall means extending upwardly from said sub-floor to define a boundary of said pond and to cause water to precipitously overflow said sidewall means from both sides of said sub-floor and to flow downwardly through said hollow tubular structures, means associated with said hollow tubular structures for enhancing the mixing of paint laden air with water to cleanse said paint laden air and to cause paint in said air to adhere to said water, and water disposal means located longitudinally along and beneath said hollow tubular outlet structures to receive water flowing downwardly therefrom as a result of overflow from said sub-floor, the apparatus further including a plurality of openings in said sub-floor for draining and cleaning said sub-floor at selected time intervals, said openings being normally closed to maintain the pond of water on said sub-floor to a substantial depth defined by the extent to which the sidewall means extends above said floor.

* * * * *